US007030776B2

(12) United States Patent
Toyama

(10) Patent No.: US 7,030,776 B2
(45) Date of Patent: Apr. 18, 2006

(54) ON-VEHICLE DEVICE INCLUDING NUMERICAL INFORMATION NOTIFICATION FUNCTION

(75) Inventor: Kazumasa Toyama, Kariya (JP)

(73) Assignee: Denso Corporation, Kariya (JP)

( * ) Notice: Subject to any disclaimer, the term of this patent is extended or adjusted under 35 U.S.C. 154(b) by 22 days.

(21) Appl. No.: 10/747,219

(22) Filed: Dec. 30, 2003

(65) Prior Publication Data

US 2004/0178929 A1 Sep. 16, 2004

(30) Foreign Application Priority Data

Feb. 28, 2003 (JP) ..... 2003-053657

(51) Int. Cl.
*G08G 1/00* (2006.01)

(52) U.S. Cl. ..... 340/928; 705/13

(58) Field of Classification Search ..... 340/928; 705/13

See application file for complete search history.

(56) References Cited

U.S. PATENT DOCUMENTS

| | | | | |
|---|---|---|---|---|
| 5,554,984 | A * | 9/1996 | Shigenaga et al. | 340/937 |
| 5,633,625 | A | 5/1997 | Gaub et al. | |
| 5,710,702 | A * | 1/1998 | Hayashi et al. | 701/1 |
| 6,249,720 | B1 * | 6/2001 | Kubota et al. | 701/1 |
| 6,337,622 | B1 * | 1/2002 | Sugano | 340/438 |
| 6,417,781 | B1 | 7/2002 | Matsumoto | |
| 6,456,935 | B1 * | 9/2002 | Ng | 701/211 |
| 6,493,562 | B1 * | 12/2002 | Yoshida et al. | 455/517 |
| 6,608,567 | B1 | 8/2003 | Matsumoto | |
| 6,744,377 | B1 * | 6/2004 | Inoue | 340/928 |
| 2002/0068555 | A1 | 6/2002 | Yoshida | |
| 2003/0018532 | A1 * | 1/2003 | Dudek et al. | 705/17 |

FOREIGN PATENT DOCUMENTS

| | | |
|---|---|---|
| FR | 2 651 352 | 3/1991 |
| FR | 2 791 620 | 6/2000 |
| JP | U-S60-164247 | 10/1985 |
| JP | A-S62-288897 | 12/1987 |
| JP | A-2001-134895 | 5/2001 |
| JP | A-2001-357424 | 12/2001 |
| JP | A-2002-245500 | 8/2002 |
| JP | A-2002-261885 | 9/2002 |
| WO | WO 9808195 | 2/1998 |

OTHER PUBLICATIONS

Preliminary search report, issued from French Patent Office for the corresponding French application No. 650454 (copy of original document), Jul. 13, 2005.

Japanese Office Action dated Oct. 11, 2005 with its English translation.

* cited by examiner

*Primary Examiner*—Thomas J. Mullen, Jr.
*Assistant Examiner*—Travis Hunnings
(74) *Attorney, Agent, or Firm*—Posz Law Group, PLC

(57) ABSTRACT

In an ETC on-vehicle device (1), notification of toll amount information is given with a sound production pattern of a buzzer (17). The toll information resulting from toll collection being conducted with a road antenna is converted to a sound production pattern by a CPU (11). For example, if the toll is 12,300 yen, the buzzer (17) sounds once with a long sound, twice with a middle sound, and three times with a short sound.

16 Claims, 7 Drawing Sheets

ON-VEHICLE DEVICE INCLUDING NUMERICAL INFORMATION NOTIFICATION FUNCTION

CROSS REFERENCE TO RELATED APPLICATIONS

This application is based upon, claims the benefit of priority of, and incorporates by reference the contents of Japanese Patent Application No. 2003-53657 filed on Feb. 28, 2003.

BACKGROUND OF THE INVENTION

1. Field of the Invention

The present invention relates to an on-vehicle device including a function for giving notification, without dependency on a display device or functions such as sound synthesis, of numerical information such as a toll on a toll road.

2. Description of the Related Art

On-vehicle devices used, for example, in ETC (Electronic Toll Collection) payment, are configured so that, when the car is traveling on a toll road such as an expressway, communication with a communication device disposed in a toll station is conducted and payment of the toll is automatically conducted without temporarily stopping at the toll station to receive a ticket and without stopping the car in order to pay the toll. Among such on-vehicle devices, there are devices that are disposed with a simple LCD or the like and include the function of displaying the toll information and displaying the fact that payment has been completed. There are also devices that conduct sound synthesis to convey the toll information.

However, in an on-vehicle device that is not disposed with such a display device or a sound-synthesizing function, but is disposed only with a simple notification function such as a buzzer or an LED, notification cannot be given in regard to the toll even if the device can give notification of the fact that automatic payment of the toll has been executed. In a case where one has overlooked the indication of the toll station, one cannot confirm how much has been paid.

SUMMARY OF THE INVENTION

The present invention has been devised in light of the aforementioned circumstances, and it is an object thereof to provide an on-vehicle device disposed with a numerical information notification function configured to be able to notify a user of toll information even when the device is one having a simple configuration that does not have a display device or a sound-synthesizing function.

According to a first aspect of the invention, when numerical information is received by communication means conducting communication with a roadside device, control means converts the received numerical information into a sound production pattern corresponding to preset numerical values and outputs this to a sounder, whereby the sounder is sounded with the sound production pattern. Thus, the driver or a passenger can confirm the numerical information by hearing the sound production pattern resulting from the sounding of the sounder. It becomes possible to provide the numerical information without using a display device or sound synthesis.

According to a second aspect of the invention, with respect to the invention of the first aspect, the control means is configured to give notification of the numerical information by differentiating the length of sounds per place of the numerical values as the sound production pattern causing the sounder to sound and causing the sounder to repeatedly produce sounds for the number of the numerical values of each place. Thus, it becomes possible to confirm the numerical information by listening to the length and frequency of the sounds outputted from the sounder.

According to a third aspect of the invention, with respect to the invention of the first aspect, the control means is configured to give notification of the numerical information by differentiating tones per place of the numerical values as the sound production pattern causing the sounder to sound and causing the sounder to repeatedly produce sounds for the number of the numerical values of each place. Thus, it becomes possible to confirm the numerical information by listening to the tones and frequency of the sounds outputted from the sounder.

According to a fourth aspect of the invention, with respect to each of the aforementioned inventions, the control means makes the numerical information received by the communication means into a preset number of significant figures to convert the numerical information into the sound production pattern. Thus, even in a case where there is a great number of significant places of the numerical information, the sound production pattern can be set so that it does not become complicated when the driver or another passenger listens to the sound production pattern.

According to a fifth aspect of the invention, with respect to each of the aforementioned inventions, switching means for switching the sound production pattern is disposed, wherein the control means stores plural sound production patterns, reads and sets the corresponding sound product ion pattern when the switching means is operated, and converts the numerical information received by the communication means to a newly set sound production pattern. Thus, it becomes possible to select a sound production pattern that the user desires and to sound the sounder, and it becomes possible to a precise communication operation corresponding to purpose.

According to a sixth aspect of the invention, with respect to each of the aforementioned inventions, the communication means includes the function of receiving the sound production pattern, and the control means is configured to convert the numerical information using the sound production pattern received from the outside via the communication means. Thus, the sound production pattern can be set from the outside via communication means, whereby it becomes possible to sound the sounder with a sound production pattern that the user desires and which is different from the preset sound production pattern.

According to a seventh aspect of the invention, with respect to each of the aforementioned inventions, sending means for sending the numerical information to a display device or a device including a sound-producing function disposed inside the vehicle is disposed, wherein the control means causes the sending means to send as needed, to the device inside the vehicle, the numerical information received by the communication means to cause the device inside the vehicle to display the numerical information or produce sounds corresponding to the numerical information. Thus, even with a configuration where the in-vehicle device itself does not include a display function, it becomes possible to display the numerical information using the display function of another device present inside the vehicle and to conduct sound-synthesized output using a sound-synthesizing function.

According to an eighth aspect of the invention, with respect to the invention of the seventh aspect, the other device inside the vehicle is at least one of a device such as a meter display device, an audio device, car speakers, an on-board computer, a portable terminal device and a printer. Thus, it becomes possible to notify the user using currently existing devices inside vehicles and other devices disposed for separate purposes.

According to a ninth aspect of the invention, with respect to the inventions of the seventh and eighth aspects, the sending means is configured to conduct communication by at least one communication method of a wired LAN, a wireless LAN, infrared communication and microwave-band communication. Thus, the invention can be applied to devices inside the vehicle by selecting a suitable method from among various methods. Also, in a case where a communication mode using any of the aforementioned communication methods is already disposed inside the vehicle, it becomes possible to send the numerical information using this.

According to a tenth aspect of the invention, with respect to each of the aforementioned inventions, the communication means is configured to communicate with a roadside device for automatic toll collection on an expressway, and the control means is configured to give notification with the sounder using toll information received by the communication means from the roadside device as the numerical information. Thus, in a case where the vehicle passes on a toll road, it becomes possible for notification to be given from the sounder inside the vehicle even in cases where the toll could not be confirmed with a display device at the toll station, such as a case where the vehicle passes through the toll station without stopping.

According to an eleventh aspect of the invention, with respect to the invention of the tenth aspect, the communication means is configured to conduct communication with a DSRC communications system and configured so as to be able to communicate with a communication device of another facility using the DSRC communications system, and the control means is configured to give notification of information that is communicable by the communication means on the basis of the result of communication with the communication device of the other facility. Thus, it becomes possible to communicate with communication devices disposed in various facilities and for the communication means to give notification of the result thereof.

BRIEF DESCRIPTION OF THE DRAWINGS

The above and other objects, features and advantages of the present invention will become more apparent from the following detailed description made with reference to the accompanying drawings. In the drawings.

Figure 1:
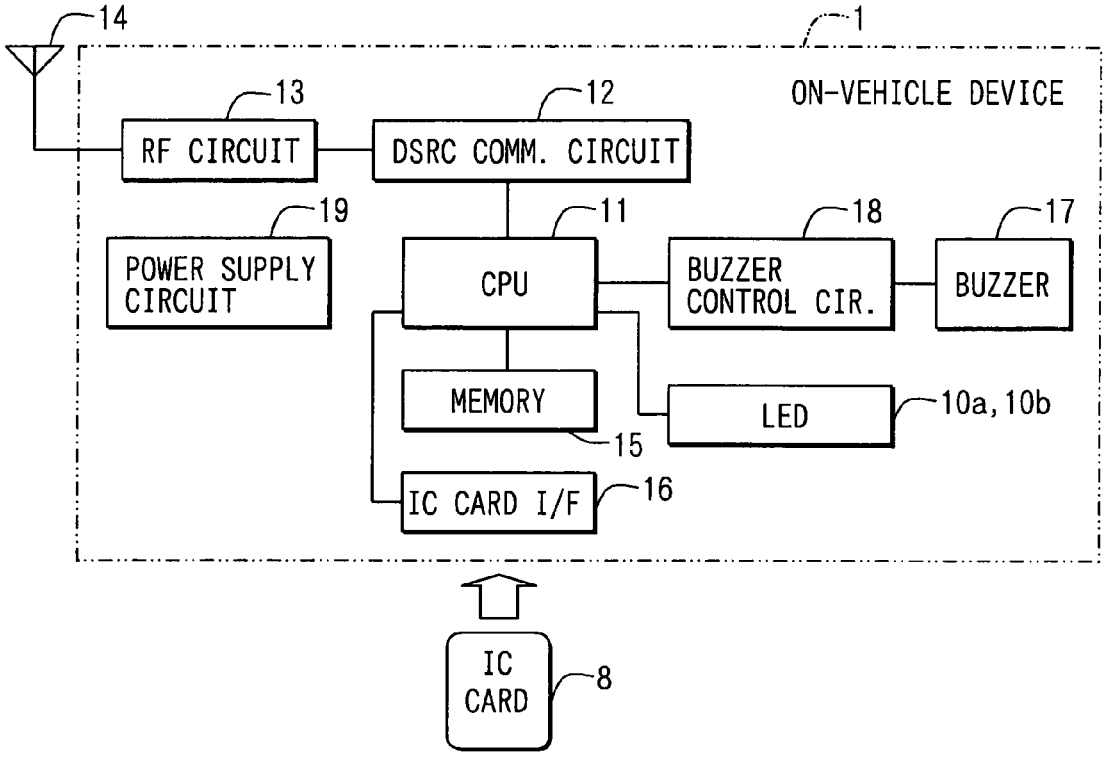
FIG. 1 is a block diagram of a first embodiment of the invention.

DESCRIPTION OF THE PREFERRED EMBODIMENTS (First Embodiment)

A first embodiment in a case where the invention is applied to an ETC on-vehicle device will be described below with reference to FIGS. 1 to 7. FIG. 2 is a diagram showing the schematic configuration of an ETC system used by an automobile (vehicle) 2 mounted with an ETC on-vehicle device 1 described in this embodiment.

A toll station on an expressway is disposed with gates for payment of a toll. In a case where the automobile 2 being used is mounted with the ETC on-vehicle device 1, the automobile 2 can use a gate disposed in an ETC dedicated lane such as shown in FIG. 2. Successively disposed at this gate, from the side where the automobile 2 enters, which is the front side of the lane, are vehicle detectors 3*a* and 3*b*, a road antenna 4 serving as a roadside device, a gate 5, a display 6 and a surveillance camera 7.

The road antenna 4 is fixed at a center portion of a gantry 4*a* and sends a signal from above to conduct communication with the on-vehicle device 1 of the automobile 2 traveling in the lane. These respective devices are connected to a toll station computer via an unillustrated lane controller, and toll collection is conducted by communication between the on-vehicle device 1 of the entering automobile 2 and the road antenna 4. The on-vehicle device 1 is configured so that an IC card 8 for toll payment is loaded in the on-vehicle device 1 and the amount corresponding to the toll is paid.

As shown in FIG. 2, the on-vehicle device 1 is formed in a compact shape so that it is disposed on the dashboard of the automobile 2 and used. An insertion slot 9 into which the IC card 8 is inserted is formed in a front surface portion of the on-vehicle device 1, and display-use LEDs 10*a* and 10*b* are disposed at the right side of the front surface portion. These LEDs 10*a* and 10*b* are lighted and controlled so as to give notification of whether or not payment has been completed when the automobile 2 passes through the toll station.

Figure 2:
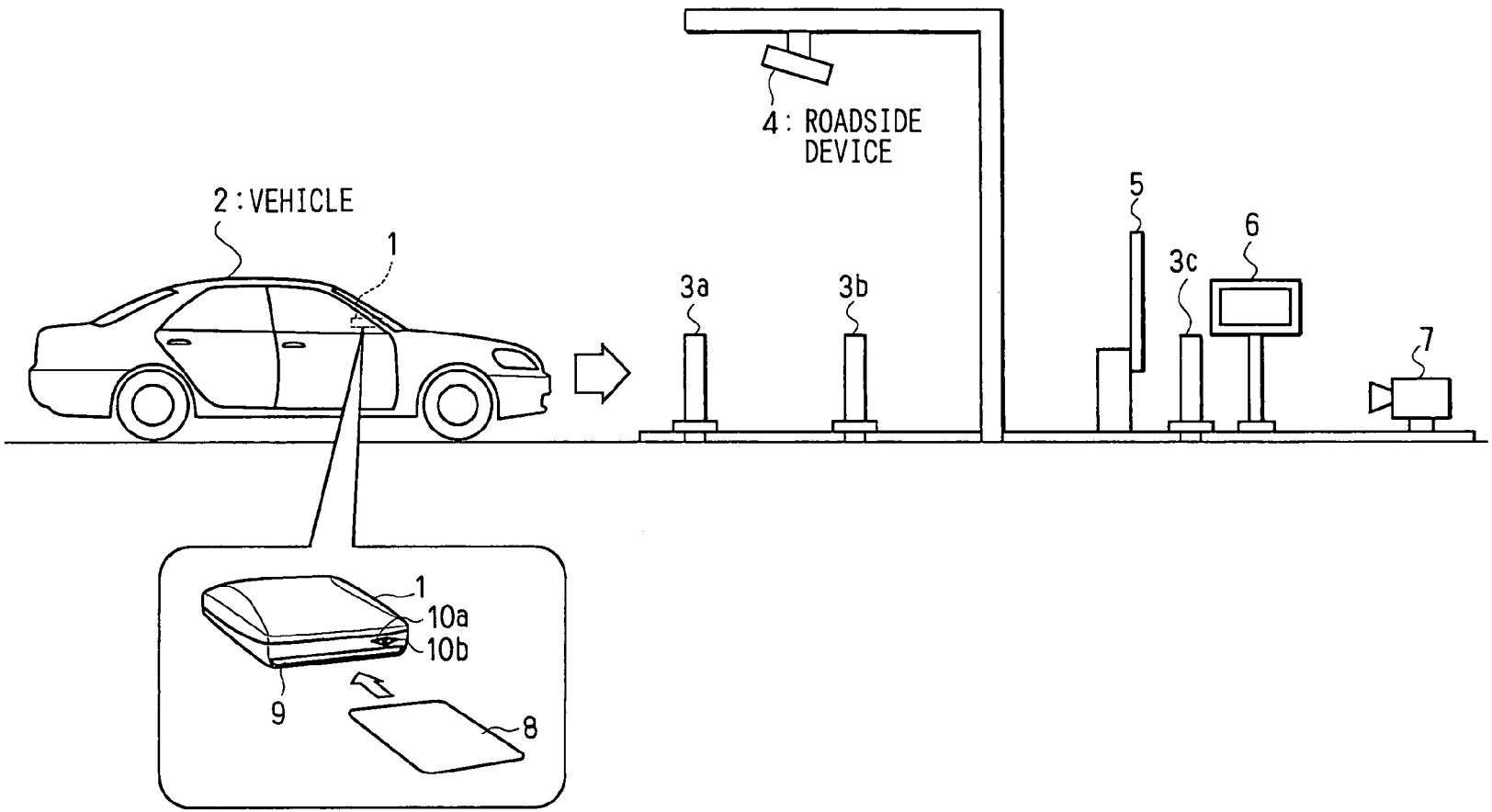
FIG. 2 is a schematic diagram of an ETC system.

FIG. 1 is a diagram showing the electrical block configuration of the on-vehicle device 1. A CPU 11 functions as control means and is configured to execute a toll collection program described later. A DSRC communications circuit 12 serving as communication means is connected to the CPU 11 and is also connected to an antenna 14 via an RF circuit 13. A memory 15 is connected to the CPU 11 so as to store various data and programs for conducting various processing such as communication and toll collection.

An IC card interface 16 is for electrically reading, when the IC card 8 is inserted through the insertion slot 9, information stored inside by the CPU 11. A sound device such as, for example, buzzer 17 serving as a sounder is connected to the CPU 11 via a buzzer sounding control circuit 18. The LEDs 10*a* and 10*b* are also connected to the CPU 11 so that lighting control is effected. A power supply circuit 19 converts the output of an on-vehicle battery to a predetermined voltage to feed the internal circuits.

Next, the action of the present embodiment will be described with reference to FIGS. 3 to 7. It should be noted that in the description of this action, because toll collection resulting from the on-vehicle device 1 is substantially the same as toll collection in a common ETC on-vehicle device, the operation thereof will be schematically described and mainly the sounding of the buzzer 17 relating to the invention will be described here.

Figure 3:
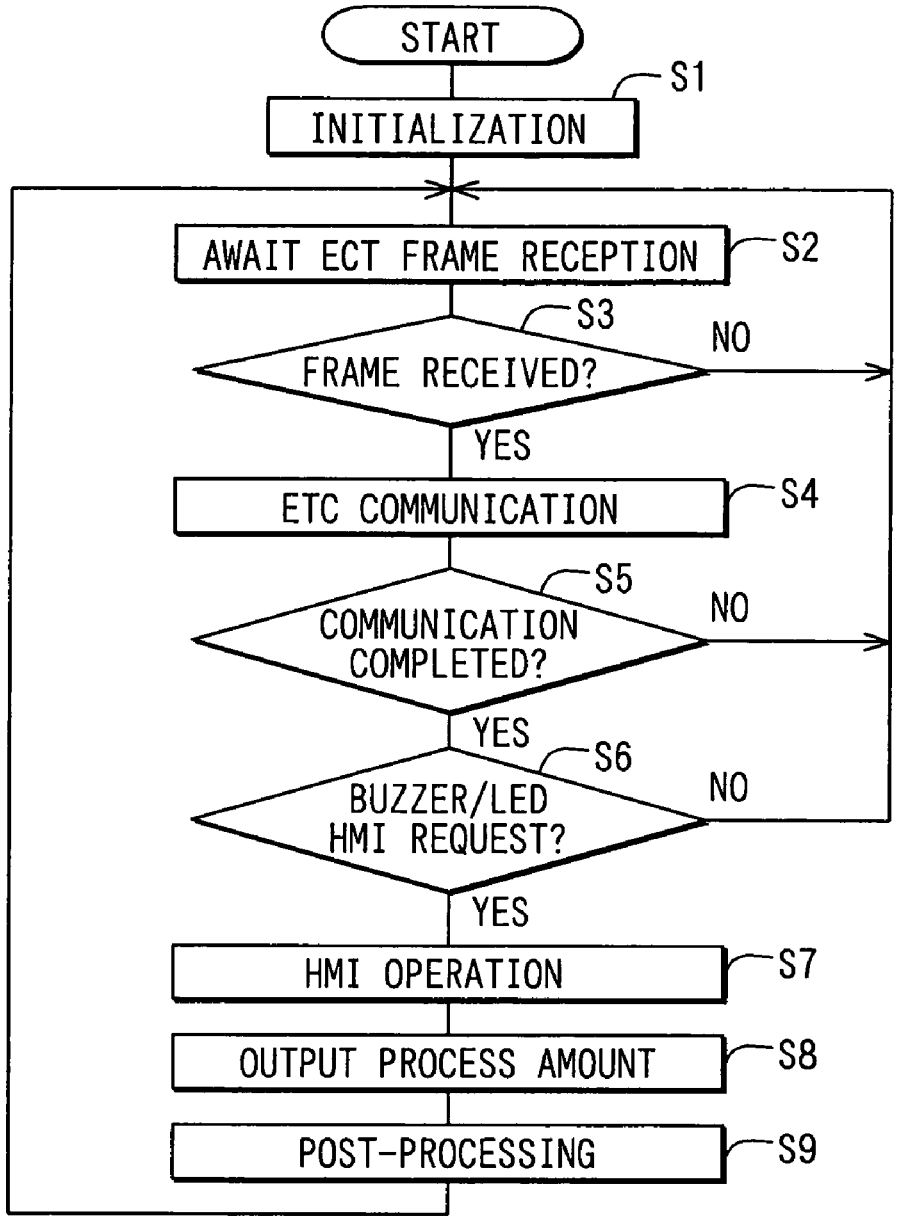
FIG. 3 is a flow chart of a schematic program for toll collection.

FIG. 3 is a flow chart showing the schematic flow of toll collection. When the CPU 11 is turned on to start the system, the on-vehicle device 1 initiates processing as follows. First, the CPU 11 executes initialization (Step S1), whereby the on-vehicle device 1 is switched from this state to a state where it waits to receive an ETC communication frame from the road antenna (Steps S2 and S3).

When the automobile 2 enters the ETC lane of the toll station and the on-vehicle device 1 receives the ETC communication frame from the road antenna 4, the received signal is demodulated by the DSRC communications circuit 12 via the antenna 14 and the RF circuit 13 and inputted to the CPU 11. The CPU 11 executes ETC communication on the basis of the inputted signal (Step S4) and continues receiving the ETC communication frame (Steps S3 to S5) until ETC communication is determined to be completed ("Yes" in Step S5).

During this time, the vehicle type of the passing automobile 2 is determined by the vehicle detectors 3*a* and 3*b*, it is determined whether or not this matches the vehicle type according to the signal sent from the on-vehicle device 1, and it is determined whether or not toll collection can be normally implemented. When toll collection by the road antenna 4 ends normally, the result thereof is sent to the on-vehicle device 1, the gate 5 is maintained in an open state and indication of the toll is displayed on the display 6.

In a case where toll collection cannot be conducted normally, indication thereof is sent from the road antenna 4 to the on-vehicle device 1, the gate 5 is closed, and the fact that automatic toll collection could not be normally conducted is displayed on the display 6. It should be noted that, in correspondence to a case where toll collection could not be normally implemented, an image of the front side of the automobile 2 is shot by the surveillance camera 7 and stored together with a registration number. Thus, the automobile 2 can be identified in the event that it has engaged in unlawful conduct.

In a case where toll collection was able to be conducted normally as described above, the CPU 11 of the on-vehicle device 1 checks whether or not there is a request for notification by the buzzer 17 and the LEDs 10*a* and 10*b* when ETC communication is completed (Step S6). In the case of "Yes", operation corresponding to an HMI request is executed in accordance with an instruction from the road antenna 4 of the toll station (Step S7). Here, for example, the buzzer 17 is made to sound and the LEDs 10*a* and 10*b* are made to light up and display in accordance with whether or not toll collection has been completed. Thus, the driver or a passenger can confirm the toll collection.

Next, the CPU 11 executes processing for outputting fee amount information resulting from the buzzer 17 as described later (Step S8). When this processing ends, the CPU 11 conducts necessary post-processing such as communication of the IC card 8 (Step S9) and ends the series of communications.

Figure 4:
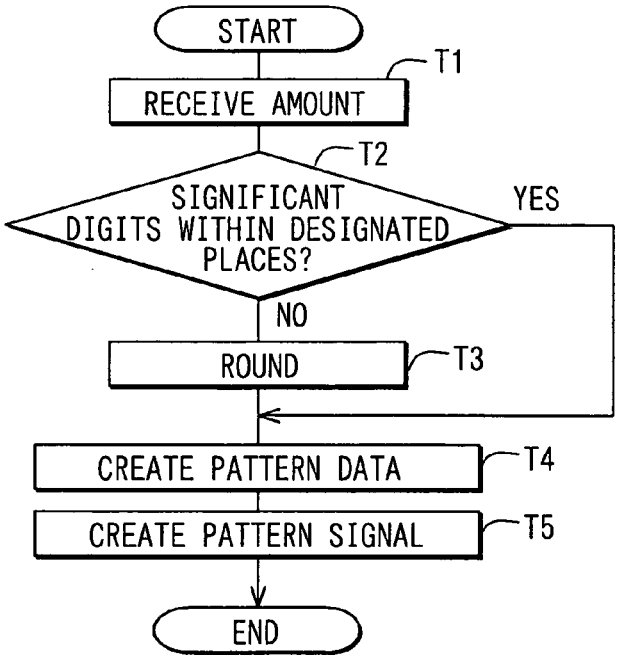
FIG. 4 is a flowchart of a program in a case where numerical information is converted to a sound production pattern.

In Step S8, processing is executed in accordance with the flow chart shown in FIG. 4. The CPU 11 first determines whether or not significant digits are within a designated number of places in order to convert the acquired amount data into a sound production pattern (Steps T1 and T2). In a case where the significant digits are not within the designated number of places, for example, in a case where the significant digits are equal to or greater than the hundreds place, the number in the tens place is rounded when the significant digit includes a numerical value in the tens place (Step T3).

Next, the CPU 11 converts the amount information of the obtained number of places into data corresponding to a sound production pattern (Step T4). The sound production pattern is created so that, for example, the buzzer 17 produces a longest sound for a number of times corresponding to the number in the highest place of the significant digits, the buzzer 17 produces a sound of a second length for a number of times corresponding to the number in the next place, and the buzzer 17 produces a shortest sound for a number of times corresponding to the number in the lowest place.

Figure 5A:
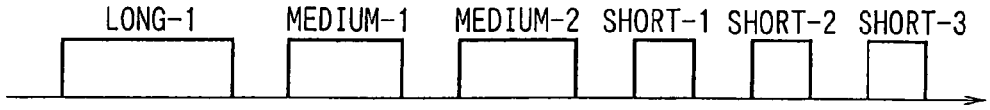
FIGS. 5A and 5B show a first example of the sound production pattern.

For example, as shown in FIG. 5A, a sound production pattern is created so that, in a case where the amount for which notification is to be given is "12,300 yen", the portion corresponding to the number "1" in the "10,000" place is sounded once with a long sound, the portion corresponding to the number "2" in the "1,000" place is sounded twice with a middle sound, and the portion corresponding to the number "3" in the "100" place is sounded three times with a short sound. The CPU 11 outputs the sound production pattern obtained in this manner to the buzzer sounding control circuit 18, which causes the buzzer 17 to sound in correspondence to the sound production pattern.

By causing the buzzer 17 to sound in this manner, the driver or a passenger can confirm the amount information by hearing the sounds of the sound production pattern. In this case, because the number of places in the amount is figured out approximately, the driver or a passenger can confirm this by hearing the sounds of the three places. Also, by using sounds of about three digit places in this manner, confirmation becomes easier than causing the buzzer 17 to sound with a detailed sound production pattern in which the number of places has been needlessly increased.

Figure 5B:
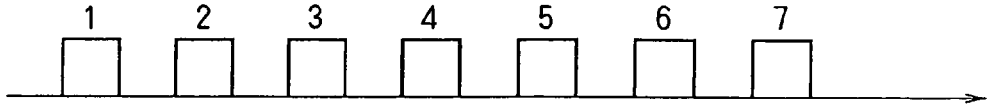
Figure 6A:
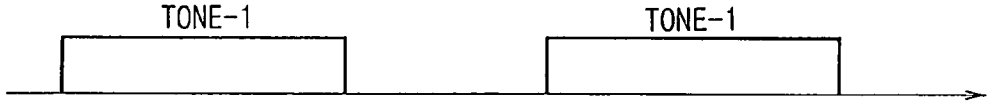
FIGS. 6A and 6B show a second example of the sound production pattern.
Figure 6B:
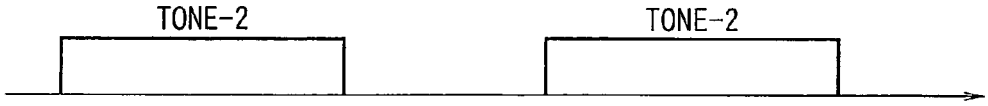
Figure 7A:
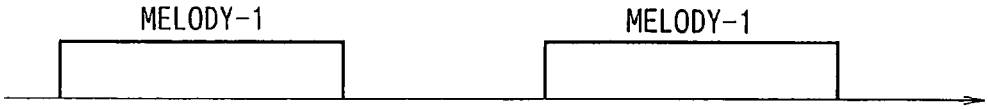
FIGS. 7A and 7B show a third example of the sound production pattern.
Figure 7B:
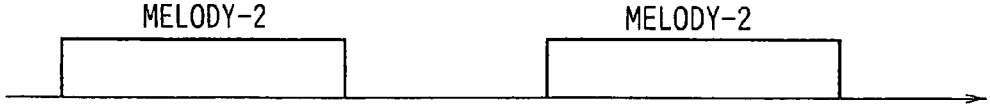

Also, when the above-described sound production pattern is followed, in the case of an amount of "650 yen" shown in FIG. 5B, the number "5" in the tens place is rounded up so that the amount becomes "700 yen". When this is outputted as the sound production pattern, the portion corresponding to the "100" place is sounded seven times with a short sound.

In the above case, when the user wishes to know the amount up to the number in the tens place, in order to correspond thereto, the amount can also be left as is, as the sound production pattern, without rounding up the number in the tens place so that the user is notified of this amount. Conversely, the invention can also be configured to give notification only of the number in the tens place. It is possible to variously set these in correspondence to the request of the user.

Moreover, notification can be given of the amount information with the same sound production pattern by making the pitches of the sounds correspond to the places rather than making the length of sounds correspond to the places. Also, the sounds can be made to correspond to the places by changing tones and melodies. In this case, the amount information for which notification is to be given can also be simplified. For example, as shown in FIGS. 6A–7B, notification can be given of the fact that toll collection has been completed with a tone 1 or a melody 1, and notification can be given of the fact that toll collection is incomplete with a tone 2 or a melody 2.

To summarize the above, the elements that can be set as the sound production pattern are (1) the length of the sounded sounds, (2) the pitch of the sounded sounds, and (3) the tone or melody of the sounded sounds. As the sound production pattern, there are also elements such as the designation of the number of significant places for which notification is to be given, the designation of places to be rounded, the setting of the processing method of "rounding", "rounding down" and "rounding up", and designation where a lower limit of the amount for which notification is to be given is designated so that the fact that the amount exceeds the lower limit amount is confirmed. By presetting these, this is useful to the user and the user is notified of the information accurately.

According to the present embodiment, the amount information regarding the toll obtained by communicating with the road antenna 4 is sounded by the CPU 11 with a sound production pattern corresponding to the amount. Thus, the driver or a passenger can confirm the toll information with the simple on-vehicle device 1 that does not have a display device or a sound-synthesizing function.

(Second Embodiment)

Figure 8:
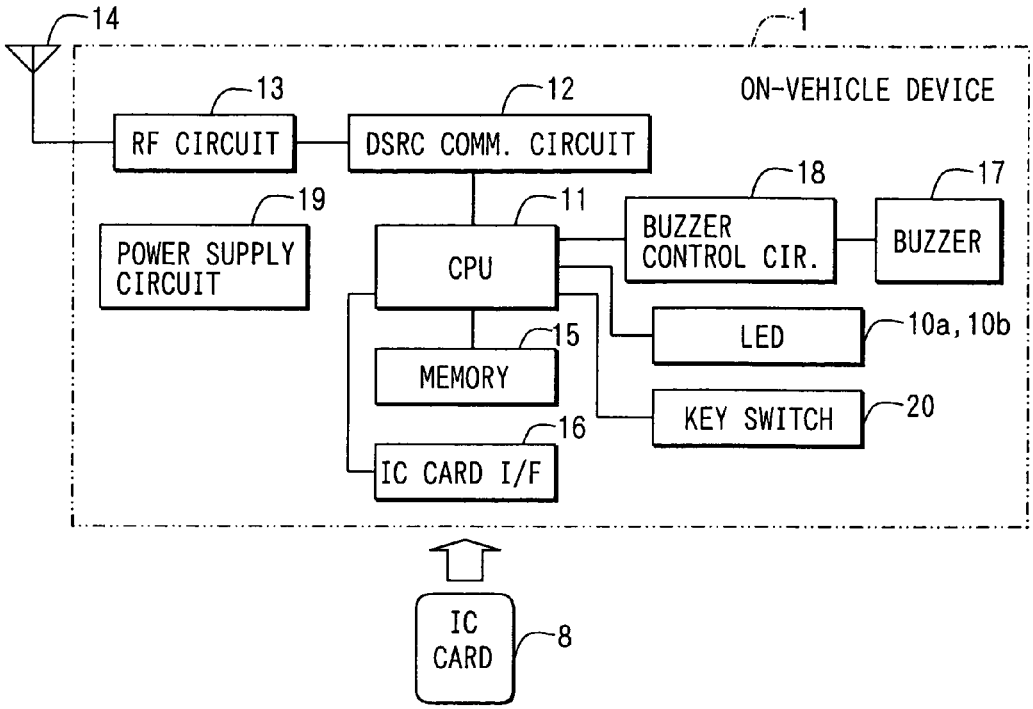
FIG. 8 is a diagram that corresponds to FIG. 1 and shows a second embodiment of the invention.
Figure 9:
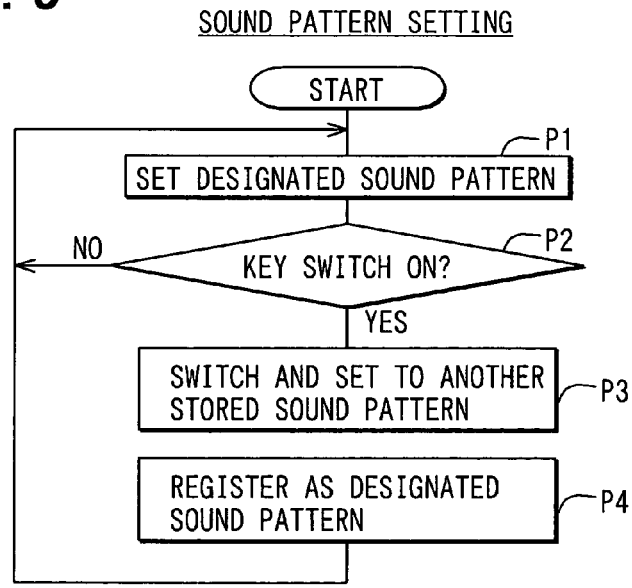
FIG. 9 is a flow chart of a processing program for sound production pattern switching and setting.

FIGS. 8 and 9 show a second embodiment of the invention, which is different from the first embodiment in that a key switch 20 is additionally disposed so that the sound production pattern can be switched and set.

As shown in FIG. 8, the key switch 20 is connected to the CPU 11. The key switch 20 is disposed as switching means so that, by operating the key switch 20, the sound production pattern can be switched.

FIG. 9 shows a program in a case where the sound production pattern is switched and set. The CPU 11 sets a preset default sound production pattern at an initial setting (Step P1). Then, when the key switch 20 is operated ("Yes" in Step P2), the CPU 11 reads and sets another sound production pattern stored in the memory 15 (Step P3) and registers the read sound production pattern as the designated sound production pattern (Step P4). Thus, thereafter the switched and set sound production pattern becomes set as the designated sound production pattern.

By storing two, three or more sound production patterns in the memory 15 so as to be switchable, the sound production pattern can be switched and set by the key switch 20, whereby the manner of notification of the toll information matching the preference of the user can be selected and notification can be executed.

(Third Embodiment)

Figure 10:
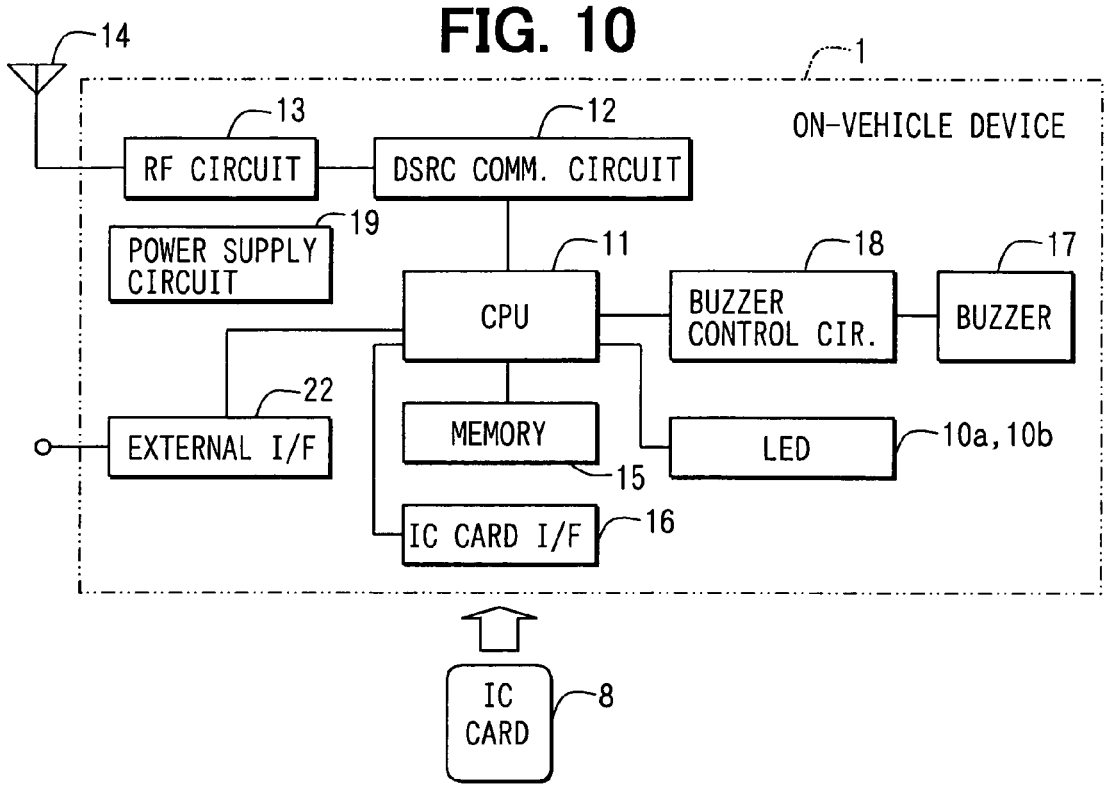
FIG. 10 is a diagram that corresponds to FIG. 1 and shows a third embodiment of the invention.

FIG. 10 shows a third embodiment of the invention, which is different from the first embodiment in that an external interface 22 (or sending means) is disposed in addition to the notification operation with the sound production pattern by the buzzer 17. The third embodiment also includes the function of sending the toll information to other devices disposed inside the vehicle, so that notification of the toll information is given using a display function and a sound-synthesizing function of those devices.

FIG. 10 shows the configuration thereof. Here, the external interface 22 has a configuration that is connectable to an in-vehicle LAN. Thus, the external interface 22 can be connected, via a LAN cable, to at least one device disposed inside the vehicle and connectable to the in-vehicle LAN, such as a meter display device, an audio device, car speakers, an on-board computer, a portable terminal device and a printer.

Thus, in addition to the notification operation of the toll information by the buzzer 17, the CPU 11 sends the toll information to, and causes the toll information to be displayed on, other devices inside the vehicle via the in-vehicle LAN from the external interface 22, to conduct sound-synthesized output. For example, the toll information can be displayed on a display device of the meter display device, the on-board computer or the portable terminal device. Also, the toll information can be outputted by the audio device or the car speakers as a result of being sound-synthesized.

Additionally, the toll information can be outputted by the printer as printed matter. This printed matter can be used as something corresponding to a receipt, so that when an expressway is used on company business, the toll information can be recorded for reimbursement of transportation expenses. Thus, this can be utilized as effective means.

It should be noted that, when external devices are connected to the external interface 22 in the above operation, the notification operation by the buzzer 17 can be cancelled. This may be achieved with a setting for automatic cancellation or with a configuration enabling selective cancellation.

Also, the information sent to the external devices is not limited to the toll information. Other information can be received via the DSRC communications circuit 12 from roadside devices of other facilities that use the DSRC communications system, and the received information can be outputted to external devices disposed inside the vehicle. Thus, it becomes possible to receive information from roadside devices without separately disposing a DSRC communications device.

(Fourth Embodiment)

Figure 11:
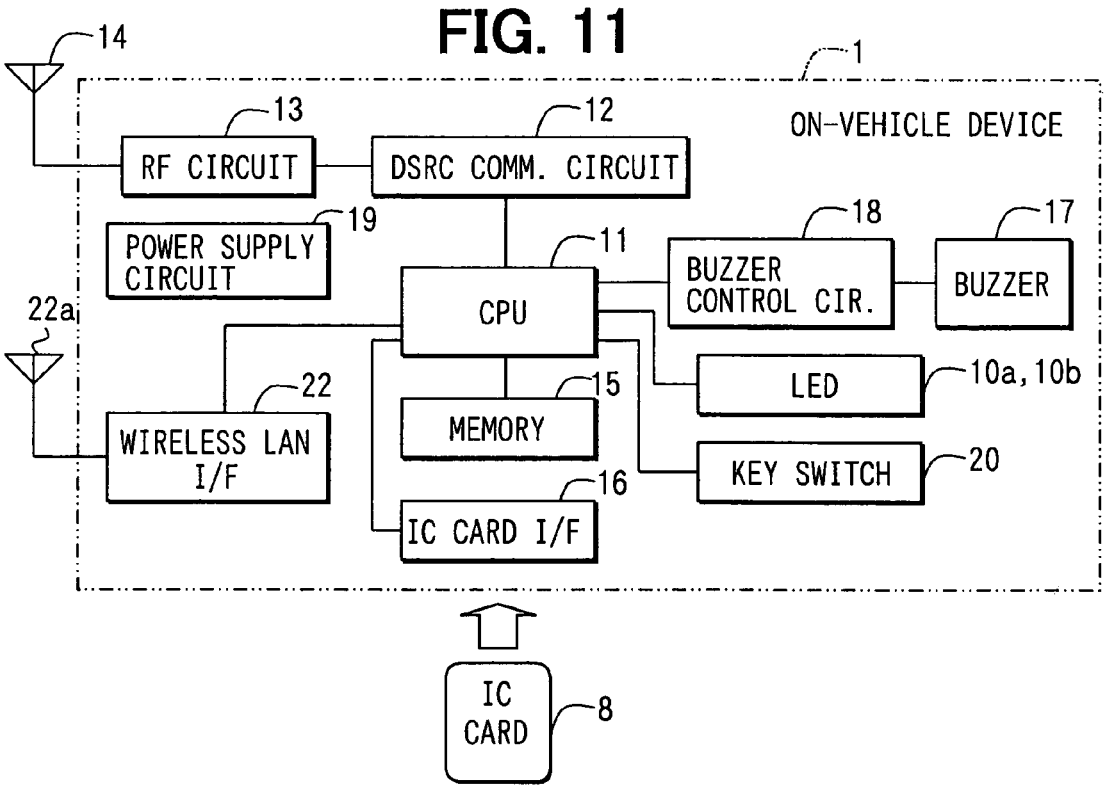
FIG. 11 is a diagram that corresponds to FIG. 1 and shows a fourth embodiment of the invention.
Figure 12:
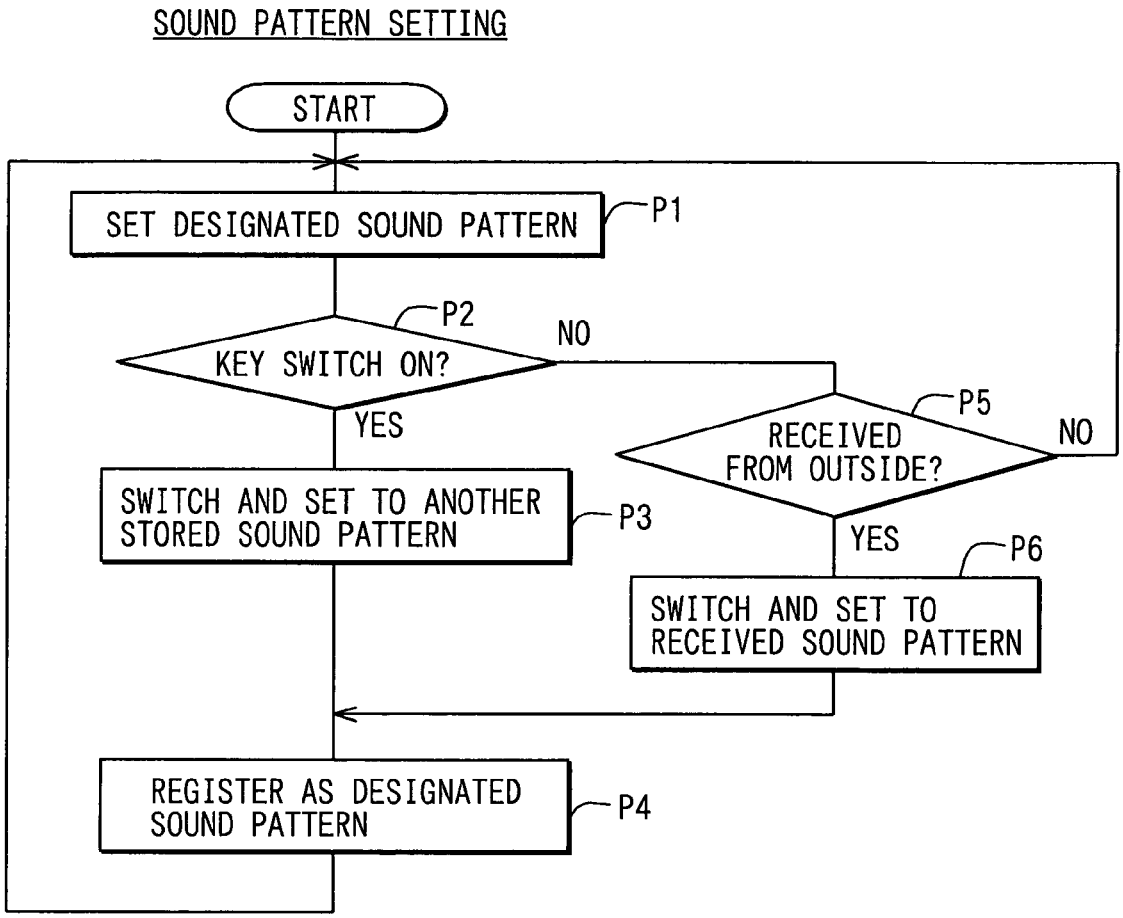
FIG. 12 is a diagram that corresponds to FIG. 9.

FIGS. 11 and 12 show a fourth embodiment of the invention, which is different from the third embodiment in that an interface for a wireless LAN is disposed in place of the external interface and the key switch 20 is disposed. The configuration of the fourth embodiment is also different from the configuration of the second embodiment in that the interface for the wireless LAN is additionally disposed.

In the configuration of FIG. 11, a wireless LAN interface 22 is disposed in place of connecting the external devices to a wired LAN with a LAN cable, whereby communication with external devices inside the vehicle is conducted. Also, in the configuration of the fourth embodiment, the key switch 20 described in the second embodiment is disposed, so that the on-vehicle device 1 is configured to be able to switch and set the sound production pattern.

Additionally, the present embodiment is disposed with a function so that the sound production pattern can be imported via the wireless LAN interface 22 from another device inside the vehicle, such as the on-board computer, and set. In regard to the toll information, how notification of the toll information is to be given is configured so that it can be conducted, separately from the processing of collection thereof, in a manner more in line with the request of the user.

The CPU 11 executes a program in the case where the switching and setting shown in FIG. 12 are to be done. The operation of the switching and setting by the key switch 20 is the same as the operation described in the second embodiment. The CPU 11 sets the default sound production pattern as the initial setting (Step P1). When the key switch 20 is operated ("Yes" in Step P2), the CPU 11 reads another sound product ion pattern, and sets and registers this as the designated sound production pattern (Steps P3 and P4).

Then, in a case where the key switch 20 is not ON, the CPU 11 determines whether or not the data of the sound production pattern is being received from the outside (Step P5). In the case of "Yes", the CPU 11 imports this and switches and sets this as the sound production pattern (Step P6). Thereafter, the CPU 11 registers the sound production pattern received via Step P4 as the designated sound production pattern and returns to Step P1.

Thus, thereafter the sound production pattern introduced from the switching and setting by the key switch 20 and other devices disposed inside the vehicle such as the on-board computer becomes set as the designated sound production pattern. By editing the sound production pattern that the user desires and importing this inside via the wireless LAN interface 22, the sound production pattern can be set to give notification of the desired toll information with a unique sound production pattern.

It should be noted that, although a common LAN was described as the wireless LAN in the present embodiment, the invention is not limited thereto. For example, the invention may also have a configuration disposed with an interface having a Bluetooth communications specification, or the invention can have a configuration disposed with an interface that can handle infrared signals.

(Other Embodiments)

The present invention is not limited to the embodiments described above and can be modified or expanded as follows.

Other than the buzzer 17, the sounder may also be a device that produces a sound such as a chime. Other devices can also be used as long as they can produce sound.

Although description was given of a case where the invention was applied to an on-vehicle device not disposed with a display device or a sound-synthesizing function, it is also possible to apply the invention to an on-vehicle device disposed with these.

The LEDs 10*a* and 10*b* of the on-vehicle device 1 may also be lighted and controlled together with the sounding of the buzzer 17. In this case, the LEDs 10*a* and 10*b* can be lighted with a pattern that is the same as the sound production pattern by causing the LEDs 10*a* and 10*b* to light during the period of time in which the sound continues, or display can be done by continuing a blinking frequency for only the period of time in which the sound continues.

The invention can also be applied to cases other than the case of automatic toll collection at a toll station on an expressway. For example, the invention can be applied to purchases made at drive-through stores, gasoline stations and convenience stores, to payment of entrance fees at amusement parks, and to payment of entrance fees at drive-in movie theaters.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An on-vehicle device including a numerical information notification function, the on-vehicle device being mounted in a vehicle and comprising:

communication means for conducting communication with a roadside device to receive numerical information;

a sounder for information notification; and control means for converting the numerical information received by the communication means into a sound production pattern corresponding to preset numerical values and sounding the sounder, wherein the control means is configured to give notification of the numerical information by differentiating the length of sounds per place of the numerical values as the sound production pattern causing the sounder to sound and causing the sounder to repeatedly produce sounds for the number of the numerical values of each place.

2. The on-vehicle device including a numerical information notification function of claim 1, further comprising switching means for switching the sound production pattern, wherein the control means stores plural sound production patterns, reads the sound production pattern set by the switching means and converts the numerical information received by the communication means.

3. The on-vehicle device including a numerical information notification function of claim 1, wherein:

the communication means includes the function of receiving the sound production pattern; and the control means converts the numerical information using the sound production pattern received from the outside via the communication means.

4. The on-vehicle device including a numerical information notification function of claim 3, wherein:

the communication means is configured to communicate with a roadside device for automatic toll collection on an expressway; and the control means is configured to give notification with the sounder using toll information received by the communication means from the roadside device as the numerical information.

5. The on-vehicle device including a numerical information notification function of claim 1, further including sending means for sending the numerical information to a display device or a device including a sound-producing function disposed inside the vehicle, wherein the control means causes the sending means to send as needed, to the device inside the vehicle, the numerical information received by the communication means to cause the device inside the vehicle to display the numerical information or produce sounds corresponding to the numerical information.

6. The on-vehicle device including a numerical information notification function of claim 5, wherein a partner device to which the sending means sends the numerical information is at least one of meter display device, an audio device, car speakers, an on-board computer, a portable terminal device and a printer.

7. The on-vehicle device including a numerical information notification function of claim 6, wherein the sending means is configured to conduct communication by at least one communication method of a wired LAN, a wireless LAN, infrared communication and microwave-band communication.

8. The on-vehicle device including a numerical information notification function of claim 5, wherein the sending means is configured to conduct communication by at least one communication method of a wired LAN, a wireless LAN, infrared communication and microwave-band communication.

9. The on-vehicle device including a numerical information notification function of claim 1, wherein:

the communication means is configured to communicate with a roadside device for automatic toll collection on an expressway; and the control means is configured to give notification with the sounder using toll information received by the communication means from the roadside device as the numerical information.

10. The on-vehicle device including a numerical information notification function of claim 9, wherein the communication means is configured to conduct communication with a DSRC communications system.

11. The on-vehicle device including a numerical information notification function of claim 10, wherein:

the communication means is disposed so as to be able to communicate with a communication device of another facility using the DSRC communications system; and the control means is configured to give notification of information that is communicable by the communication means on the basis of the result of communication with the communication device of the other facility.

12. The on-vehicle device including a numerical information notification function of claim 1, wherein the control means makes the numerical information received by the communication means into a preset number of significant figures to convert the numerical information into the sound production pattern.

13. The on-vehicle device including a numerical information notification function of claim 12, further comprising switching means for switching the sound production pattern, wherein the control means stores plural sound production patterns, reads the sound production pattern set by the switching means and converts the numerical information received by the communication means.

14. The on-vehicle device including a numerical information notification function of claim 13, wherein:

the communication means includes the function of receiving the sound production pattern; and the control means converts the numerical information using the sound production pattern received from the outside via the communication means.

15. An on-vehicle device including a numerical information notification function, the on-vehicle device being mounted in a vehicle and comprising:

communication means for conducting communication with a roadside device to receive numerical information;

a sounder for information notification; and control means for converting the numerical information received by the communication means into a sound production pattern corresponding to preset numerical values and sounding the sounder, wherein the control means is configured to give notification of the numerical information by differentiating the length of sounds per place of the numerical values as the sound production pattern causing the sounder to sound and causing the sounder to repeatedly produce sounds for the number of the numerical values of each place, wherein the control means is configured to give notification of the numerical information by differentiating tones per place of the numerical values as the sound production pattern causing the sounder to sound and causing the sounder to repeatedly produce sounds for the number of the numerical values of each place.

16. The on-vehicle device including a numerical information notification function of claim 15, wherein the control means makes the numerical information received by the communication means into a preset number of significant figures to convert the numerical information into the sound production pattern.

* * * * *